United States Patent [19]

Cunningham et al.

[11] 3,934,116

[45] Jan. 20, 1976

[54] ELECTRIC HEATER ASSEMBLIES

[75] Inventors: Donald M. Cunningham, Pittsburgh; Ralph Santoro, Verona, both of Pa.

[73] Assignee: Emerson Electric Co., St. Louis, Mo.

[22] Filed: Oct. 23, 1974

[21] Appl. No.: 517,366

Related U.S. Application Data

[62] Division of Ser. No. 427,823, Dec. 26, 1973, Pat. No. 3,859,721.

[52] U.S. Cl. ..... 219/336; 29/520; 29/611; 338/228

[51] Int. Cl.[2] .... H05B 1/00; H05B 3/78; F24H 1/00

[58] Field of Search ..... 219/335–336, 219/316, 318, 523, 526, 536, 542; 29/610, 520, 611, 613; 338/228

[56] References Cited

UNITED STATES PATENTS

| | | | |
|---|---|---|---|
| 2,629,041 | 2/1953 | Fein et al. | 219/336 X |
| 3,778,592 | 12/1973 | Williams | 219/336 |

*Primary Examiner*—C. L. Albritton
*Attorney, Agent, or Firm*—Michael Williams

[57] ABSTRACT

The heater assembly comprises a sheathed electric heating element and an elastomeric bushing within a sheath end opening. A mounting flange is rigidly secured to the sheath inwardly of an end, and the bushing is held under longitudinal compression at the time the mounting flange is secured to the sheath.

4 Claims, 6 Drawing Figures

ELECTRIC HEATER ASSEMBLIES

This is a division of application Ser. No. 427 823, filed Dec. 26, 1973 now Pat. No. 3859721.

BACKGROUND AND SUMMARY

The invention is particularly adapted for electric heating elements for heating liquids in a container, such as the commercially known water heater elements adapted to heat water in a tank. The heater is held to the wall of the tank by a mounting flange which is rigidly connected to the heater sheath.

The heater assembly comprises a conventional sheathed electric heating element, the components of which include a tubular metal sheath; a resistance member, such as a helical resistance wire, within the sheath and electrically insulated from the inner wall surface thereof by compacted refractory material; and metal terminal pins electrically connected to the ends of the resistance wire. A mounting flange is rigidly connected to the end (or ends) of the sheath by a mechanical connection, such as by staking. Representative of the prior art of connecting a metal flange to a sheathed heating element by a staking operation is U.S. Pat. No. 2,670,529.

An end seal of some type is usually disposed within the open end of the sheath, and U.S. Pat. Nos. 2,489,998 and 2,861,162 disclose rubber bushings held within the sheath end. In mechanical staking of a mounting flange or screw plug to a sheathed heater, the staking displaces the metal of the flange or plug inwardly towards the tubular leg of the heater. However, in order to effect a satisfactory seal between the engaging surfaces of the mounting flange and tubular leg, the latter must have sufficient internal backup to prevent it from collapsing during the staking operation.

It has been found that a relatively soft rubber bushing within the end of the tubular leg does not provide a satisfactory backup and for that reason relatively hard bushings, such as hard plastic or rubber were used. The hard bushings provided satisfactory backup but did not always provide an effective seal. Since finished tank assemblies are presently being tested with air pressure to check for leaks, it is necessary to provide an effective seal that will not leak air at approximately 100 p.s.i.

Our invention enables the use of the softer rubber bushings to provide the effective air seal, and the invention makes use of the fact that rubber behaves similar to fluids when subjected to pressure. By applying end pressure axially on the rubber bushing within the end of the tubular element, it is possible to transmit that pressure to the side wall of the tube to provide the necessary backup.

DESCRIPTION OF THE DRAWING

In the drawing accompanying this specification and forming a part of this application, there are shown, for purpose of illustration, several embodiments which our invention may assume, and in this drawing.

DESCRIPTION OF THE PREFERRED EMBODIMENT

Figure 1:
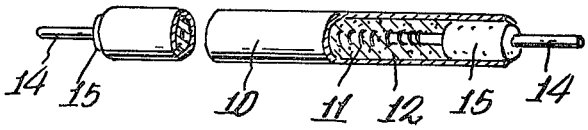
FIG. 1. PRIOR ART
FIG. 1 is a broken perspective view of a conventional tubular heating element.

The heater assembly comprises a conventional sheathed electric heating element, such as shown in FIG. 1. Briefly, the element comprises an elongated tube 10 formed of any suitable metal to meet requirements. When the heating element is to be operated in a corrosive environment, the tube has frequently been formed of copper or a copper alloy.

A resistance member, such as the helically wound resistance wire 11, is disposed within the sheath and is insulated therefrom by granular refractory material 12, such as magnesium oxide. A metal terminal pin 14 is mechanically and electrically connected to each end of the resistance wire and each terminal pin extends outwardly of the respective tube end for connection to source of electrical energy. An insulating bushing 15 is disposed within each end of the tube and in the disclosed embodiment this bushing is formed of silicone rubber.

The bushings 15 have a fairly close fit with the tube openings and as an example, the tube may have an outside diameter of 0.375 inches and an inside diameter of 0.319 inches, while the bushing may have an outside diameter of 0.317 inches. The assembly thus far described is subjected to a rolling or side pressing operation to reduce the diameter of the tube (to an outside diameter of 0.315 inches in the example given) and thus compact the refractory material and firmly lock the bushings in place.

Figure 2:
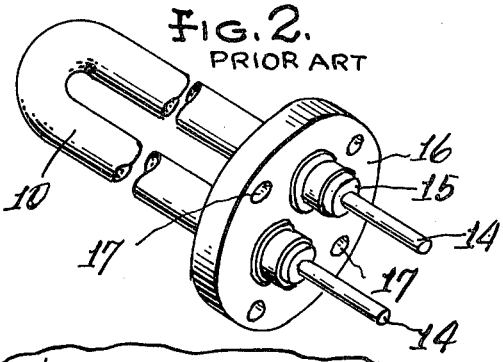
FIG. 2. PRIOR ART
FIG. 2 is a broken perspective showing the element of FIG. 1 after bending to hairpin shape, with a mounting flange connected across the tubular legs.

For water heater purposes, the tubular element is usually bent to the hairpin shape shown in FIG. 2, and a mounting member 16 is rigidly connected across the legs of the bent element. The member 16 may be in the form of a flat plate, having holes near its periphery to pass mounting bolts, or it may be in the form of a screw plug so that it may be threaded into an opening in the tank wall. In the construction illustrated in FIGS. 2 through 4, the member 16 is shown as a flat plate with holes 17 to pass mounting bolts.

Figure 3:
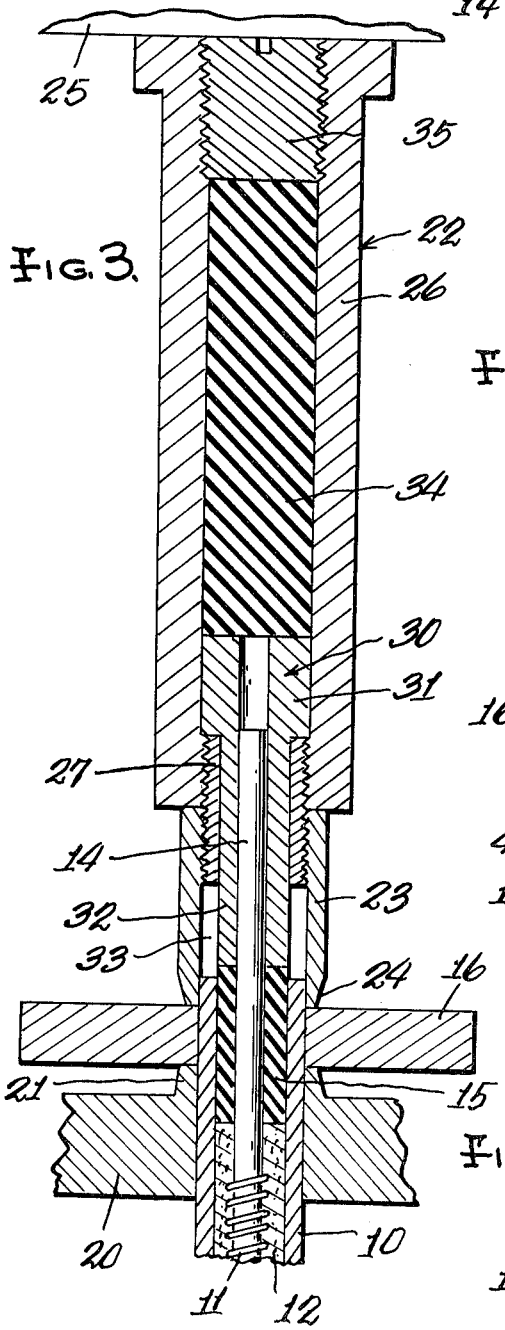
FIG. 3 is an enlarged, fragmentary, longitudinal sectional view illustrating apparatus at the start of the operation of assembling a mounting member to a tubular sheath.
Figure 4:
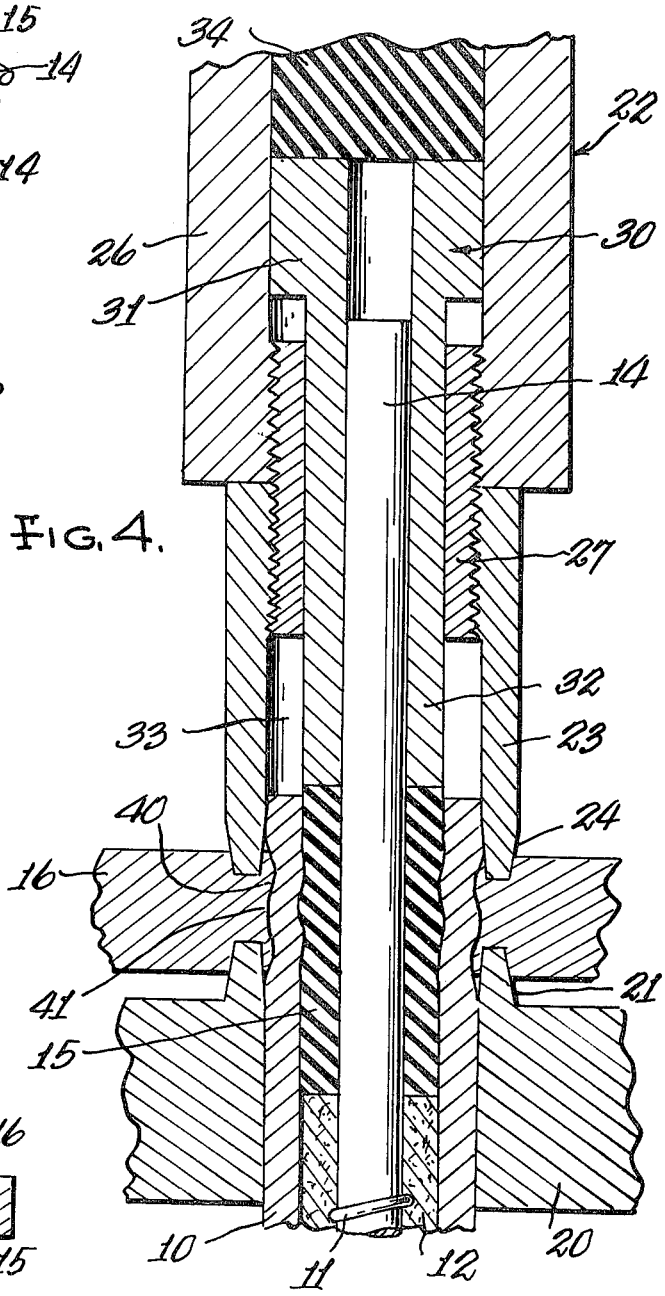
FIG. 4 is a view similar to FIG. 3, but further enlarged, showing the apparatus after it has effected the assembly.

FIGS. 3 and 4 show only one heater leg and it will be appreciated that if two legs of a hairpin heater are to be connected to the mounting plate 16, side-by-side assemblies would be required. As seen in FIG. 3, the inner end of the bushing 15 abuts the adjacent end portion of the compacted refractory material 12 to reduce voids and restrict its inward movement; however, the bushing 15 is firmly locked in position and would resist longitudinal movement in any case.

The mounting plate 16 has an opening to closely pass the end of the tube 10 so that the parts may be positioned as shown in FIG. 3. A stationary lower stake holder 20 surrounds, and is clamped to, the tube 10 so that the latter is held against longitudinal movement. The holder 20 has a conical stake projection 21 extending upwardly therefrom. A punch holder 22 carries the upper staking member 23, the latter having a lower conical projection 24.

The holder 22 is adapted to be secured to the movable platen 25 of a press (not shown) and the lower stake holder 20 is adapted to be carried by the bed of the press. The holder 22, in the disclosed embodiment, comprises a sleeve 26 which is threaded at its lower end to receive an exteriorly threaded sleeve 27, and the staking member 23 is also threaded on the sleeve 27 so that its upper end abuts the lower end of the sleeve 26.

A plunger 30 is mounted for axial movement and is provided with a head portion 31 slidable within the sleeve 26 and a reduced lower portion 32 slidable within the sleeve 27. The plunger 30 has an axial opening to closely but slidably receive the end of the terminal pin 14, and the end of the sheath 10 is adapted to fit within the annular space 33. Resilient means 34 is disposed within the sleeve 26, between the upper end of the head portion 31 and a plug 35 threaded into the upper end of the sleeve 26. In the disclosed embodiment, the resilient means is in the form of a compressible rubber plug, but such means may also take the form of a compression spring.

When the platen 25 of the press is moved downwardly, the punch holder 22 will drive the upper staking projection 24 into the upper surface of the mounting plate 16 and in turn will drive the lower staking projection 21 into the lower surface of the plate. Movement of the platen 25 will be controlled so that the staking projections will reach the condition shown in FIG. 4 wherein it will be seen that the staking projections have cut into the metal and displaced metal inwardly to seal against the exterior surface of the tube 10.

As the punch holder is driven downwardly, the lower end of plunger 32 is pressed against the upper end of the bushing 15 and the head portion 31 will move upwardly into the sleeve 26 but will be resiliently resisted by the resilient means 34 so as to apply an axial force downwardly on the bushing 34. The resiliency of the means 34 may be chosen to apply the axial force in a predetermined amount to adequately back up the tube while mechanical staking the steel flange in the described manner. As seen in FIG. 4, the staking operation with the bushing under longitudinal compression, causes flange metal to be forced against the tube at the staking projections, as suggested at 40, while the tube intermediate staking projections bulges slightly, as suggested at 41, and the combination of these conditions produces a water and air tight seal between the tube 10 and the wall surface defining the flange opening. The bushing, being locked in the tube end by the rolling or side pressing action, and being further locked in the staking operation, will be in sealing contact with the inner wall of the tube and the periphery to the terminal pin to produce a water and air tight seal at these locations.

It has been calculated that an internal pressure of about 10,000 to 11,000 p.s.i. on the copper tube will bring it to the yield point and pressure above this value would actually cause the tube to expand. Again, by calculation, it has been determined that an axial end force on the bushing, of the size noted, about in the order of about 500 pounds will supply sufficient force to raise the internal pressure on the tube close to the yield point and provide the backup required.

DESCRIPTION OF OTHER EMBODIMENT

Figure 5:
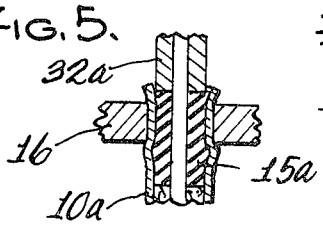
FIG. 5 is a fragmentary longitudinal sectional view, drawn to reduced scale, showing another form of assembly.
Figure 6:
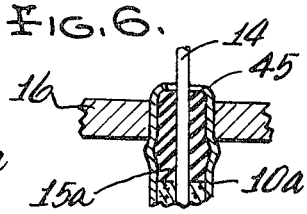
FIG. 6 is a view similar to FIG. 5 showing an optional step in the assembly.

Since it has been determined that sufficient internal pressure may be applied to tube to bring it to and beyond its yield point, it is possible to cause the tube to expand to a water and air tight seal with the wall surface defining the opening in the mounting flange without a staking operation, and FIGS. 5 and 6 show this condition. In this case an axial end force in excess of 500 pounds has been applied to the bushing **15*a* by the plunger 32*a*. It will be noted that the tube 10*a* has been expanded in sealing contact with the flange opening and that the tube on opposite sides of the flange has bulged slightly beyond the size of the flange opening to lock the tube in place. It has been determined that the bushing will remain in its longitudinally stressed relation after end pressure thereon has been removed; however, in some cases it may be desirable to turn in the tube end, as seen at 45 in FIG. 6,** before end pressure is removed from the bushing.

We claim:

1. An electric heating element, comprising:

a metal tube, a resistance member within said tube and insulating material within said tube to electrically insulate said resistance member from said tube, a pair of metal terminal pins, each having one end within a respective tube end and mechanically and electrically connected to a respective end of said resistance member and having an opposite end extending outwardly of the respective tube end, a metal mounting member for attaching said heating element to the wall of a container, said mounting member having a hole through which one end of said tube passes with close tolerance, means holding said tube one end within said mounting member hole and providing a sealing connection therebetween, said means including metal deformation adjacent to said tube end and the surface defining the hole in said mounting member, and an elastomeric bushing closely fitting within said tube one end and closely around the terminal pin thereat, said bushing being locked within said tube one end under axial compression.

2. The construction according to claim 1 wherein said holding means comprises a stake connection between said mounting member and said one tube end, wherein metal of said mounting member around the hole in the latter is deformed inwardly against said tube end.

3. The construction according to claim 1 wherein said holding means comprises an outward deformation of said tube one end against the surface defining the hole in said mounting member.

4. The construction according to claim 1 wherein the extremity of said tube one end is turned over the end of said bushing.

* * * * *